United States Patent [19]

Wilson

[11] Patent Number: 4,581,035

[45] Date of Patent: Apr. 8, 1986

[54] WATERLESS DYE COMPOSITION AND METHOD OF USE THEREOF FOR COLORING THERMOPLASTIC ARTICLES

[75] Inventor: Robert B. Wilson, Greenville, S.C.

[73] Assignee: Crucible Chemical Company, Greenville, S.C.

[21] Appl. No.: 669,354

[22] Filed: Nov. 8, 1984

[51] Int. Cl.[4] ..... D06P 5/00

[52] U.S. Cl. ..... 8/508; 8/509; 8/512; 8/513; 8/515; 8/516; 8/580; 8/583; 8/584; 8/610; 8/922; 8/924; 8/926; 8/927; 8/928; 8/582

[58] Field of Search ..... 8/527, 580, 582, 509, 8/510, 512, 513, 515, 516, 521, 508, 583, 584, 610

[56] References Cited

U.S. PATENT DOCUMENTS

| | | | |
|---|---|---|---|
| 3,824,125 | 7/1974 | Hinton et al. | 8/115.6 |
| 4,215,992 | 8/1980 | Sato et al. | 8/445 |
| 4,293,305 | 10/1981 | Wilson | 8/115.6 |
| 4,394,126 | 7/1983 | Wilson | 8/115.6 |
| 4,401,700 | 8/1983 | Weder et al. | 8/580 |
| 4,529,405 | 7/1985 | Wilson | 8/583 |

*Primary Examiner*—A. Lionel Clingman
*Attorney, Agent, or Firm*—Bailey & Hardaway

[57] ABSTRACT

A waterless dye composition for apparel and other thermoplastic articles comprises a triglyceride fat or oil of the formula $$\begin{array}{l} CH_2O\text{—acyl} \\ | \\ CHO\text{—acyl}' \\ | \\ CH_2O\text{—acyl}'' \end{array}$$

wherein acyl, acyl' and acyl'' each are saturated or unsaturated substituted or unsubstituted linear alkanoyl of an even number of carbon atoms from 10–30 carbon atoms and an organic colorant.

The composition can further contain one or more of:

A. an aromatic polyester of the formula $C_6H_{z'}$-$(COOR_1)_z$, wherein z is 3, 4,5, or 6; z' is 6-z and $R_1$ is higher alkyl;

B. a cycloaliphatic diester of the formula

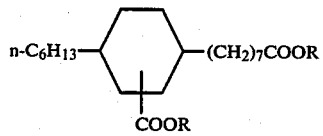

wherein R is substituted or unsubstituted straight or branched chain alkyl of 4–20 carbon atoms, polyoxyalkylene of the formula $HO(C_xH_yO)_nC_x$-$H_y$—or phosphated polyoxyalkylene of the formula $$(HO)_2P(=O)O(C_xH_{2x}O)_nC_xH_{2x}$$

or a salt thereof, wherein $(C_xH_{2x}O)_n$ is $(CH_2CH_2O)_n$, $(C_3H_6O)_n$ or $(CH_2CH_2O)_p$—$(C_3$-$H_6O)_q$, n is 2–22, and the sum of p+q is n; or C. a bisterephthalate ester of an alkylphenylpolyoxyethanol.

A process for coloring apparel or other articles, fabricated from polyester, polyamide, polyurethane, acrylic, halogenated polyolefin or epoxy plastic, comprises exposing an article to the foregoing compositions, maintained at a temperature between 100° C. and the temperature at which the plastic is degraded, for a time adequate to achieve the desired degree of coloration.

25 Claims, No Drawings

WATERLESS DYE COMPOSITION AND METHOD OF USE THEREOF FOR COLORING THERMOPLASTIC ARTICLES

DESCRIPTION

TECHNICAL FIELD

This invention relates to waterless compositions, particularly adapted for immersion coloring of plastic articles, whether intended for apparel or general utility applications.

BACKGROUND ART

A continuous process for waterless dyeing of textile and plastic materials has been proposed by Hermes in U.S. Pat. Nos. 4,047,889 and 4,055,971. The vehicle disclosed is a high boiling glycol or glycol ether.

Woods et al. have proposed, in U.S. Pat. No. 539,323, a composition for blackening and dressing leather, consisting of neat's foot oil, tallow, petrolatum and nigrosine coloring matter, ground in fatty acid, such as stearic acid.

Kertesz has disclosed, in U.S. Pat. No. 3,693,653 a process for dyeing cotton with sulfur colors, wherein the dyed materials are subjected to treatment with acids and solutions of acetates. Prior art treatment with Prussian blue mixed with linseed oil was said to be dangerous.

The use of tinting or treating compositions, containing an oil or fat plus an auxiliary agent, e.g., a sulfonated material, have been recited by Ellis (U.S. Pat. No. 1,723,271), Platt et al. (U.S. Pat. No. 1,840,290) and Whitehead (U.S. Pat. No. 2,042,752).

Sato et al., in U.S. Pat. No. 4,215,992, have proposed use of a dyeing assistant containing, among other components, an ester of an aliphatic polyhydric alcohol of 2–8 hydroxyl groups.

McLaughlin et al. (U.S. Pat. No. 3,369,970) have disclosed a hair dye, containing a basic dye, a water-immiscible oil and borax.

Weder et al., in U.S. Pat. No. 4,401,700, have proposed the use of a dyeing composition containing mineral oil, metal stearate and dye.

Rau, in U.S. Pat. No. 374,320, recites dyeing in a water and oil vehicle.

The use of ethoxylated materials for coloring of objects has been disclosed by Lenz et al. (U.S. Pat. No. 3,362,779) and Kressner et al. (U.S. Pat. No. 4,332,587).

Hinton, Jr. et al., in U.S. Pat. No. 3,824,125, have proposed the use of higher trialkyl trimellitates in laundry compositions to improve soil release properties of synthetic fibers, such as polyesters.

Compositions containing esterified derivatives of a hydrogenated Diels-Alder adduct of linoleic acid and acrylic acid, intended for use in various textile-treating compositions, have been disclosed by Wilson, in U.S. Pat. Nos. 4,293,305 and 4,394,126, incorporated herein by reference.

Although a variety of solvent systems have been suggested for dyeing of articles in waterless systems, none presently available provides rapid, failure-free dyeings, which are done without producing obnoxious effluents or otherwise being unacceptable from a commercial viewpoint.

It is an object of this invention to provide a composition for waterless immersion coloring of plastic articles, produced by the apparel and other industries. Such articles include, but are not limited to buttons, zippers, garments, carpeting, ribbons, draperies, shoe strings, sewing thread, lace, socks, plastic tubing and pipe, plastic coated wire, ropes, polyester and polyamide films, toys, and housings for pencils, pens, kitchen utensils and telephones.

It is a further object of this invention to provide a method for rapid waterless coloring of such articles.

DISCLOSURE OF THE INVENTION

In one aspect, this invention relates to a vehicle for waterless dip dyeing of thermoplastic articles, comprising a triglyceride fat or oil of the formula $$\begin{array}{l} CH_2O\text{—acyl} \\ | \\ CHO\text{—acyl}' \\ | \\ CH_2O\text{—acyl}'' \end{array}$$

wherein acyl, acyl' and acyl'' are independently selected from saturated or unsaturated substituted or unsubstituted alkanoyl of an even number of carbon atoms from 10–30 carbon atoms and an organic colorant.

The compositions can further contain at least 5% by weight of one or more of

A. an aromatic polyester of the formula $C_6H_{z'}(COOR_1)_z$, wherein z is 3, 4, 5 or 6; z' is 6-z; $R_1$ is substituted or unsubstituted higher alkyl or an alkylphenol ether of an alkoxyalkanol;

B. a diester of a hydrogenated Diels-Alder adduct of linoleic and acrylic acids or C. A bisterephthalate ester of an alkylphenylpolyoxyethanol.

In another aspect, this invention relates to a process for waterless coloring of thermoplastic articles, fabricated from a plastic composition, comprising exposing an article to the foregoing compositions, maintained at a temperature between 100° C. and the temperature at which the plastic degrades, for a time adequate to achieve the desired degree of coloration.

"Triglyceride fat or oil," as used in the specification and claims, includes, but is not limited to, materials such as naturally-occurring oils and fats, particularly non-drying oils, semi-drying oils, drying oils, lard, tallow and the like. These materials are essentially mixed glycerides of acids of 10–30 carbon atoms, which can be saturated or unsaturated and can be substituted, for example, with a hydroxyl group. The fats or oils used in the dye vehicles of this invention can be used as readily available or can be partially or completely hydrogenated.

Non-drying oils, useful in the practice of this invention, contain large amounts of oleic acid radicals (alkanoyl is oleoyl). Included within this group of oils are palm oil, coconut oil, olive oil, peanut oil, date oil and rice oil. A typical member of this group, olive oil, conains 83.5% of oleic acid units, 9.4% by weight of palmitic acid units, 4.0% by weight of linoleic acid units, 2.0% by weight of stearic acid units and 0.9% by weight of arachidic acid units. Another member of this group, peanut oil, contains 8.3% by weight of palmitic acid units, 3.1% by weight of stearic acid units, 2.4% by weight of arachidic acid units, 3.1% by weight of behenic acid units, 1.1% by weight of lignoceric acid units, 56.0% by weight of oleic acid units and 26.0% by weight of linoleic acid units.

Semi-drying oils contain large amounts of oleic and linoleic acid units. Typical semi-drying oils include corn oil, cottonseed oil, wheat oil, sesame oil, brazil nut oil, soybean oil and rapeseed oil. Corn oil, for example contains 0.1–1.7% by weight of myristic acid units, 8–12% by weight of palmitic acid units, 2.5–4.5% by weight of stearic acid units, 0.2–1.6% by weight of hexadecenoic acid units, 19–49% by weight of oleic acid units and 34–62% by weight of linoleic acid units. Another representative oil of this group, soybean oil, contains 26% by weight of oleic acid units, 49% by weight of linoleic acid units, 11% by weight of linolenic acid units and 14% by weight of saturated acids.

Drying oils contain large amounts of linoleic or linolenic acid units. For example, sunflower oil contains 6.4% by weight of palmitic acid units, 1.3% by weight of stearic acid units, 4.0% by weight of arachidic acid units, 0.8% by weight of behenic acid units, 21.3% by weight of oleic acid units and 66.2% by weight of linoleic acid units. Safflower oil contains 6.4% by weight of palmitic acid units, 3.1% by weight of stearic acid units, 3.1% by weight of arachidic acid units, 0.2% by weight of oleic acid units and 76.6–79.0% by weight of linoleic acid units. It will be understood that when drying oils are used in the practice of this invention, the oils will not have been "boiled," that is, heated with metal-containing catalysts, e.g. lead oxide and manganese dioxide, to begin oxidation and polymerization reactions so that the resulting oil "dries" faster than raw oil.

Naturally-occurring fats, which can be used in the practice of this invention, include lard (hog fat) and tallow. Lard contains a higher proportion of unsaturated acids than beef or sheep fat (tallow). Typical compositions for tallow are 37–43% by weight of oleic acid units, 24–32% by weight of palmitic acid units, 20–25% by weight of stearic acid units, 3–6% by weight of myristic acid units and 2–3% by weight of linoleic acid units.

The fats or oils, particularly the oils, used in the practice of this inventiion can also be partially or completely hydrogenated. Oils are commonly hydrogenated using nickel catalysts. It is preferred that the triglyceridic vehicles used in the process of this invention contain at least 50% by weight of oleoyl or linoleoyl units or at least 50% by weight of oleoyl, linoleoyl and stearoyl units.

Particularly preferred for dip dyeing is a composition is a composition using sunflower oil. Also preferred is a composition containing 10–90 parts by weight of sunflower oil and 90–10 parts by weight of partially hydrogenated soybean oil. It is preferred that the soybean oil be material commercially designated as partially hydrogenated soybean oil.

An optional component of the dyebaths is one or more high boiling petroleum oils, having a high flash point. These materials are commercially known as mineral oil, petrolatum, liquid paraffin, etc. Inclusion of upwards of 5% by weight of these materials in the dyebaths is contemplated.

"Aromatic polyester," as used in the specification and claims, means an ester formed by reaction between a polybasic aromatic acid of the benzene series and a higher alkanol, so as to accomplish complete esterification of all carboxyl functions therein. "Higher alkanol" means a substituted or unsubstituted alkanol of at least six carbon atoms, for example, hexanol, octanol, 2-ethylhexanol, isodecanol, decanol, hexadecanol, octadecanol, docosanol, oleyl alcohol, linoleyl alcohol or the like. A practical limit on the number of carbon atoms in the alkyl is about 22 carbon atoms.

Also included among "higher alkanols" for the purposes of this invention are alkylphenol ethers of alkoxyalkanols, having the formula $$C_aH_{2a+1}—C_6H_4—O(C_xH_{2x}O)_bC_xH_{2x}OH,$$

wherein a is 1–12; b is 1–24 and x is 2 or 3, optionally including blocks of ethyleneoxy and propyleneoxy units.

The esters can be made by reaction between, for example, trimellitic acid, and the selected alkanol, conveniently in a fashion so as to remove or entrain by-product water. Alternatively, the aromatic polyesters can be prepared by transesterification between a lower ester, e.g. trimethyl trimellitate and the higher alkanol. In such a reaction, the lower boiling alcohol will normally be removed from the reaction site by distillation.

Contemplated among aromatic polyesters are esters of benzene tetra-, penta- and hexacarboxylic acids, wherein R is as above. Accordingly, esters of prehnitic, mellophanic, pyromellitic, trimesic, trimellitic and hemimellitic acids are included, as well as esters of benzenepentacarboxylic acid and mellitic acid.

Although triesters of any of the benzenetricarboxylic acids can be used, it is preferred to use triesters of 1,2,4-benzenetricarboxylic acid, also known as trimellitic acid. Preferred esters are tris(2-ethylhexyl) trimellitate, trisisodecyl trimellitate, trisisooctyl trimellitate, tridecyl trimellitate, and trihexadecyl trimellitate. It will be understood that mixed esters, such as hexyl, octyl, decyl trimellitate can also be used. Most preferred is tris(2-ethylhexyl) trimellitate (CAS No. 3319-31-1), also known as trioctyl trimellitate, which can be purchased from Eastman Chemical Products, Inc., Kingsport, Tenn., as Kodaflex ® TOTM.

One preferred composition of the invention contains at least 5% by weight of aromatic polyester, more preferably a trialkyl trimellitate of 6–22 carbon atoms in the alkyl group.

The compositions can also contain at least 5% by weight of a cycloaliphatic diester of the formula

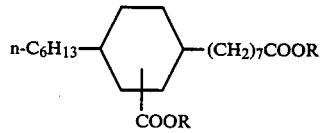

wherein R is substituted or unsubstituted straight or branched chain alkyl of 4–20 carbon atoms, polyoxyalkylene of the formula $HO(C_xH_yO)_nC_xH_y$— or phosphated polyoxyalkylene of the formula $$(HO)_2P(=O)O(C_xH_{2x}O)_nC_xH_{2x}$$

or a salt thereof, wherein $(C_xH_{2x}O)_n$ is $(CH_2CH_2O)_n$, $(C_3H_6O)_n$ or $(CH_2CH_2O)_p$—$(C_3H_6O)_q$, n is 2–22 and the sum of p+q is n. Other cycloaliphatic diester compounds which can be used are those wherein R is $ArCOO(CH_2CH_2O)_nCH_2CH_2$—, $ArCOO(C_3H_6O)_nC_3H_6$—, $ArCOO(C_2H_4O)_p(C_3H_6O)_qC_3H_6$— or $ArCOO(C_3H_6O)_p$—$(C_2H_4O)_qC_2H_4$—, wherein n, p and q are as above and Ar is substituted or unsubstituted mono- or bicyclic aryl of up to 15 carbon atoms.

The dibasic cycloaliphatic acid employed in making the compositions of this invention is a Diels-Alder adduct of acrylic acid and linoleic acid and can be prepared as described by Ward in U.S. Pat. No. 3,753,968. The diacid has the formula

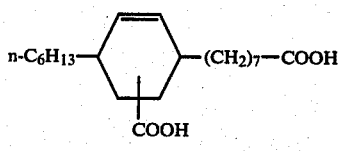

and therefore is a mixture of (5 and 6)-carboxy-4-hexyl-2-cyclohexene-1-octanoic acids. The diacid is available commercially from Westvaco, designated as "Diacid 1550".

Preparation of adducts from conjugated octadecadienoic acid and unsaturated acids and/or their hydrogenation has also been described by Teeter et al, *J. Org. Chem.*, vol. 22 (1957) at 512–514, Ward in U.S. Pat. No. 3,899,476 and Ward et al in U.S. Pat. No. 3,981,682.

The preparation of esters from the $C_{21}$ diacid adduct was reported by Ward et al, *J. Amer. Oil Chemists' Soc.*, vol. 57 (1957) at 219–224. Ethoxylated esters containing 4–119 ethylene oxide units are said to be effective lime soap dispersants. The alkyl esters are reported as being useful in lubricant applications, including use as textile lubricants and plasticizers for PVC.

The diacid can be esterified with alcohols using, for example, acidic catalysts such as p-toluenesulfonic acid, methanesulfonic acid or sulfuric acid. During the esterification, the reaction mixture is preferably also treated with a decolorizing agent, e.g., carbon or clay.

The diacid is reduced following esterification to a saturated compound. A nickel catalyst such as Raney Nickel, nickel on kieselguhr or nickel on alumina can be used. The required amount varies up to 5–10% by weight of the ester.

Hydrogenation is carried out after esterification to prevent nickel from complexing with the free acid. Other catalysts, e.g., platinum or rhodium, avoid this problem, but are prohibitive in cost. The catalyst can be removed by filtration through a plate and frame filter press. The product is the resulting filtrate.

Polyoxyalkylene diesters are prepared by reaction of the diacid, in the presence of an alkaline catalyst, with ethylene or propylene oxide. Reaction will occur at both acid sites. Addition of ethylene oxide is allowed to continue until the product becomes at least dispersible or, preferably, soluble in water. This will correspond to addition of a total of 5–25 ethylene oxide units. The product obtained using ethylene oxide has a structure before hydrogenation represented by the formula:

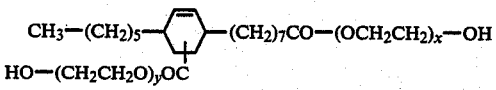

x + y = 5–25

The phosphorylated product is readily obtained by reaction with phosphorus pentoxide. The saturated diester can be obtained by nickel-catalyzed hydrogenation.

In the case of the phosphorylated derivative, hydrogenation should precede phosphorylation. The phosphorylated derivatives can be converted to salts thereof by reaction with a metal hydroxide. Sodium and potassium salts are preferred.

Compounds in which R is $ArCOO(CH_2CH_2O)_nCH_2CH_2$—, etc. are obtained by treating polyoxyalkylene intermediates with an aromatic acid, e.g., benzoic, toluic or mellitic acid, usually with an acidic catalyst. Hydrogenation of the double bond in the cycloaliphatic ring can be done before or after esterification with the aromatic acid.

Representative of substituted alkyl R which may be used in the products of this invention are butoxybutyl, 10-hydroxystearyl, 10-hydroxydecyl, 10-halostearyl, ω-alkanoyloxyalkyl or the like.

Preferred cycloaliphatic diesters for use in accordance with the principles of the invention are those wherein:

(a) R is straight or branched chain alkyl of 4–20 carbon atoms,
(b) R is 2-ethylhexyl, lauryl or stearyl,
(c) R is $HO(CH_2CH_2O)_nCH_2CH_2$—,
(d) R is $HO(C_3H_6O)_nC_3H_6$—,
(e) R is $HO(C_2H_4O)_p(C_3H_6O)_qC_3H_6$—,
(f) R is $(HO)_2P{=}O(OCH_2CH_2)_nOCH_2CH_2$— or a salt thereof,
(g) R is $C_6H_5CO(OC_2H_4)_nOC_2H_4$—,
(h) R is $CH_3C_6H_4CO(OC_2H_4)_nOC_2H_4$—
(i) R is $C_6H_5CO(OC_3H_6)_nOC_3H_6$—, and
(j) R is $CH_3C_6H_4CO(OC_3H_6)_nOC_3H_6$—.

In one preferred embodiment, the compositions of this invention will contain at least 5% by weight of a cycloaliphatic diester, wherein R is alkyl or 6–20 carbon atoms. Most preferably, R is 2-ethylhexyl.

Another preferred composition will contain at least 5% by weight of trialkyl trimellitate, wherein alkyl is of 6–22 carbon atoms and at least 5% by weight of cycloaliphatic diester, wherein R is alkyl of 6–20 carbon atoms.

Compositions of this invention can also contain at least 5% by weight of a bisterephthalate ester of an alkylphenylpolyoxyethanol of the formula

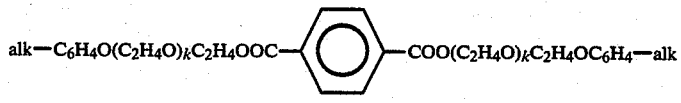

wherein alk is straight or branched chain alkyl of 4–15 carbon atoms and k is 3–20.

It will be understood that alk-$C_6H_5OH$ includes products known as octylphenol, nonylphenol and dodecylphenol, which are alkylation products of propylene or butylene oligomers. These products are actually mixtures of compounds. Nonylphenol, for example is a technical grade mixture of monoalkylphenols, predominantly para-substituted, in which the side chains are isomeric branched chain alkyl. Octylphenol may be mainly 1,1,3,3-tetramethylbutylphenol.

The number of oxyethylene units, designated by "k," also corresponds to a mixture. The product known as nonoxynol is a nonylphenol ether containing, on the average 15 1,2-oxyethanediiyl units (k is 14). The product known as octoxynol is a mixture of polyoxyethylated octylphenols, containing 5–15 oxyethylene units, that is, k is 4–14.

In bisterephthalate esters, used as an optional additive in the dip dye compositions of this invention, it is preferred that the alkylphenol be selected from octylphenol or nonylphenol and that the degree of ethoxylation be 4–6, i.e., k is 3–5.

Preferred dip dye compositions, containing materials other than triglyceride fats or oils, or hydrogenated fats or oils, will contain 5–90% by weight of fat or oil, particularly sunflower oil. Other compositions will contain 10–85% by weight of fat or oil, including hydrogenated fat or oil, or 5–85% by weight of fat or oil, including hydrogenated forms.

Most preferred compositions will contain 5–85% by weight of triglyceride fat or oil, including hydrogenated forms thereof, 95–15% by weight of aromatic polyester and 0–15% by weight of cycloaliphatic diester.

The types of plastic materials which can be colored using the compositions and method of this invention include, but are not limited to, polyesters, polyamides, polyurethanes, acrylics, halogenated polyolefins and epoxy plastics. However, textile- and apparel-related articles are commonly made from polyesters, polyamides, polyurethanes and acrylics, which substrates are preferred for the practice of this invention. Pipe and tubing are commonly made from chlorinated polyethylene (CPE) or post-chlorinated PVC (PCPVC).

Polyester articles include those made from poly(alkylene terephthalates), such as poly(ethylene terephthalate), or polyesters made from cyclohexanedimethanol. Typical of polyester articles are presewn garments, including slacks, jeans, dresses, shirts, scarves and the like. Also included within the scope of polyester articles are buttons, draperies, laces, seatbelts, ribbons, zippers and other notions, as well as chips of polyester resins, polyester coatings on wire or metal, polyester articles (including those made from styreneated polyesters), polyester film, toys, components of automobiles and airplanes and housings for pencils, pens or household articles.

Polyamides particularly contemplated as substrates in the practice of this invention include those known as nylons 6; 6,6 or 6,10. Articles which can be colored in accordance with the invention include the same types of articles as for polyesters, as well as lingerie and hosiery. It is common, for example, to employ polyamide teeth in zipper constructions. Polyamides are often used for carpeting and ropes.

Acrylic plastics, contemplated within the scope of this invention include straight acrylics, such as polyacrylonitrile, and modacrylics. The latter are copolymers of acrylonitrile or methacrylonitrile, generally with vinyl chloride or vinylidene chloride. Articles made from acrylics include clothing, carpeting and notions.

Also included among acrylics are high impact resins, whether comprising blends or graft copolymers. These are commonly identified as ABS resins. Articles made therefrom include chips, coatings for wire and metal, telephone housings, toys, impact-resistant moldings for automobiles and airplanes, and housings for pencils, pens and kitchen utensils.

Polyurethanes include a myriad of compositions, made by reaction, for example, between glycols and organic di- or polyisocyanates. Among the glycols, used to make polyurethanes, are simple glycols, such as the alkylene glycols, and polymeric glycols, including polyether and polyester glycols. Articles containing polyurethane, include rain wear, artificial leather, toys, and moldings and extrusions for automobiles and airplanes. Any of these articles can be colored by the teachings of the instant invention.

In some instances, the foregoing types of plastics can be blended with natural or synthetic cellulosic materials and colored according to this invention.

"Organic colorant," as used in the specification and claims, includes both dyes and pigments of any structure. Normally, the dyes or pigments which are employed need not be soluble in water. Therefore, such dyes and pigments will not usually contain water-solubilizing functions, such as a plurality of sulfonic acid groups. The dyes/pigments used in the practice of this invention generally will be chosen from among water-insoluble dyes, which may also be known as disperse dyes. Included within this class of dyes, which can be used on fibers such as cellulose acetate, polyamides or polyesters, from any kind of dyeing medium are colors of azo, azomethine, nitroarene and anthraquinone structures. It will be understood that the dyes useful in the practice of the present invention are not limited to these classes of compounds.

The dyes or pigments used in the practice of this invention may be identified by their chemical names, for example:

3-nitro-$N^4$-phenylsulfanilanilide, a yellow dye; p-[p-(phenylazo)phenylazo]phenol, a red-yellow dye; ethyl 4-hydroxy-1-anthraquinonecarbamate (an orange dye); 1-amino-4-hydroxyanthraquinone, a red dye; 1-amino-2-bromo-4-hydroxyanthraquinone, a red-blue dye or 4,5-diaminochrysazin, a blue dye.

The dyes alternatively may be identified in accordance with standard chemical handbooks, such as "The Color Index," third edition, The Society of Dyes and Colors and the American Association of Textile Chemists and Colorists (1971). This sort of handbook correlates dye structure with trade names. Typical of colorants identified in accordance with this handbook, which can be used in the practice of this invention, are Solvent Orange 20; Acid Blue 83 (C.I. 42660), Acid Blue 59 (C.I. 50315), Direct Blue 86 (C.I. 74180); Direct Red 81 (C.I. 28160) and Acid Yellow 36 (C.I. 13065).

Cationic dyestuffs can also be used in the practice of this invention, for example Rhodamine 6G, Rhodamine B, Rhoduline Blue 6G and Methylene Blue BB.

Similarly, metallized azo dyestuffs can be employed in the practice of this invention. Representative metallized azo dyes which can be employed are Co, Ni, Cu or Cr complexes of coupling products of 2-amino-4-nitrophenol and resorcinol; 2-amino-4-chloro-5-nitrophenol and acetoacetanilide; dianisidine and 3-hydroxy-2-naphthanilide; 2-amino-4-chloro-5-nitrophenol and 2-aminonaphthalene or the like.

It will further be understood that other textile-treating agents, such as optical brighteners, e.g. styrylnaphthoxazole compounds, can be applied, along with dyes or pigments.

The dyes/pigments can be used in any form, that is, as presscake or as dried pressed dye. The addition of dispersing agents is optional. Alternatively, the dyes or pigments can be added to the dye bath in a solvent/dispersing medium compatible with the dye bath. It is convenient and preferred, in the practice of this invention, to use solid disperse dyes free of additives.

It has been found, in accordance with this invention that articles can be dyed or colored very rapidly and very homogeneously. Normally, immersion in the dye bath for as little as 30 seconds at 160° C. will give significant coloration. However, for even faster results, the dyeings can be done at 180°-200° C. or higher. Employing the compositions of this invention at 200° C. or more does not result in smoking or pollution of the processing plant, which is a problem when ethylene or diethylene glycol are the dyeing solvents. In practice, it is feasible to use a temperature, up to that at which the plastic being dyed, will degrade. However, temperatures between 120°-235° C., most preferably 140°-235° C., will be preferred.

Although it is preferred to dye the articles being treated by immersion in a bath of the dye composition, the dyes can also be applied by spraying. Then, the sprayed articles should be heated in a bath to at least 140° C. to complete uptake of the dye into the article.

Whether the article is dyed by immersion or otherwise, the dyed article is normally cleaned with a solvent to remove excess dye. Preferably, the solvents used for cleaning are chlorinated or fluorinated hydrocarbons. However, highly chlorinated solvents, such as perchloroethylene and trichloroethylene are preferred for cleaning by immersion in a liquid bath. Fluorochlorocarbons, such as dichlorodifluoromethane, chlorotrifluoromethane, which are gases at ambient temperatures or slightly above, can be used for vapor-phase cleaning of the dyed articles. Normally, means will be used to recover and recycle the cleaning solvent, rather than discharging it to the atmosphere.

A further advantage of the process of the invention is that it is essentially self-contained and effluent free, that is, little or no material is lost or discharged to the atmosphere.

In the apparatus of this invention, the major components include a dip tank, a dye recovery unit, a solvent cleaning tank, a solvent recovery still and a drier. The dip tank will be provided with heating means and stirring means, so as to permit circulation of the dyeing solution within the dip tank and to a dye recovery unit external thereto.

The dye recovery unit normally includes filtration means for removal of solid debris from used dye solutions and distilling and condensing means for recovery of the solvent. The purified dye solution can be recycled to the dip tank, with addition of dye or other additives to provide the desired composition in the dip tank, or can be stored for later use.

It is preferred, in coloring many types of textile-related articles, including jeans, shorts, lingerie, carpeting, hosiery, zippers and lace, as exemplary, to provide squeeze roller means, essentially functioning as wringers, to remove excess dye solution from treated articles. The dye solution removed at this point can be cycled to the external recovery unit or can be returned directly to the dip tank.

Articles leaving the squeeze roll station are passed into the solvent cleaning tank to complete removal of any excess or unadherent dye matter. It is preferred to use a plurality of solvent cleaning tanks. It is also preferred to circulate solvent from the tank through an external solvent recovery unit, provided with filters to remove solid materials and distilling and condensing means for purifying solvent, and to return purified solvent to the system. Dye recovered on the filter or as residue from the distillation can be returned to the system for recycle. When a plurality of solvent cleaning tanks are employed, it is preferred to flow solvent counter currently to the direction in which the articles being treated, are moved.

The final component of the apparatus is the drying means, such as a hot air drier, from which articles leaving the system can be inspected and packaged. Solvent vapors from the hot air drier can be condensed and returned to the system.

BEST MODE FOR CARRYING OUT THE INVENTION

In a most preferred aspect, the compositions of this invention will contain 5-85% by weight of sunflower oil and 95-15% by weight of a mixture of trialkyl trimellitate, wherein alkyl is of 6-22 carbon atoms, and cycloaliphatic diester, wherein alkyl is of 6-20 carbon atoms; and organic colorant. Most preferably, the trialkyl trimellitate is tris(2-ethylhexyl)trimellitate and the cycloaliphatic diester is the bis(2-ethylhexyl)diester in 60:40 to 90:10 weight ratio.

A most preferred process in accordance with this invention is one wherein the article being treated is exposed to the foregoing composition, maintained at a temperature of 140°-235° C. for a time adequate to achieve the desired degree of coloration.

Without further elaboration, it is believed that one skilled in the art can, using the preceding description, utilize the present invention to the fullest extent. The following specific embodiments are, therefore, to be construed as merely illustrative and not limitative of the remainder of the disclosure in any way whatsoever. In the following examples, the temperatures are set forth uncorrected in degrees Celsius. Unless otherwise indicated, all parts and percentages are by weight.

EXAMPLE 1

Dyeing of Polyester Fabric in Sunflower Oil Dye Bath

Dye bath comprising sunflower oil, containing 5 grams/liter of Disperse Blue 60, was prepared. The dye bath was heated to 185° C., while a swatch of polyester fabric was immersed therein for 30 sec. The swatch was removed from the bath, washed with a halogenated solvent and dried. The sample was dyed a deep, uniform blue.

EXAMPLE 2

Dyeing of Polyester Sample in Sunflower/Soybean Oil Mixture (a) A mixture of sunflower and soybean oils (80:20 by weight) is used as in Example 1 for dyeing of a polyester sample. Similar results are obtained.

(b) Similar results are obtained using a mixture of sunflower and soybean oils (20:80 by weight) or sunflower and hydrogenated soybean oils (20:80).

EXAMPLE 3

Preparation of Cycloaliphatic Diester (R is 2-ethylhexyl)

To a three-necked flask fitted with stirrer, thermometer, nitrogen purge condenser, side-arm receiver and heating mantle were charged 352 g (1 mole) of Diacid 1550, 273 g (2.1 moles) of 2-ethylhexanol, 1.5 g of p-toluenesulfonic acid and 2 g of decolorizing carbon. Air was purged from the flask with nitrogen and the reaction mixtue was stirred and heated to 160°-170° C. for 4–6 hours. Water formed during the reaction was collected in the side-arm receiver. The reaction was continued until the acid value was below 5 mg KOH/g. The catalyst and carbon were removed by filtration. The ester product and 25 grams of nickel on kieselguhr were charged to a stirred, heated pressure vessel. The mixture was heated to 160°–170° C. and pressurized to 400 psig with hydrogen. A sample was removed after 6–8 hours for determination of the iodine value. The reaction was continued until the iodine value was below 0.5 g of iodine/100 g of sample.

The product was cooled to 50° C. and the catalyst was removed by filtration.

Esters are prepared similarly from:

(1) Diacid 1550 and decyl alcohol, 1:2 molar ratio (2) Diacid 1550 and tridecyl alcohol, 1:2 molar ratio (3) Diacid 1550 and Neodol 25 (a mixture of 12–15 carbon alcohols), 1:2 molar ratio.

EXAMPLE 4

A. Preparation of Polyoxyethylene Unsaturated Cycloaliphatic Diester, R is $HO(CH_2CH_2O)_nCH_2CH_2$—)

To a stirred autoclave fitted with heating and cooling coils was charged 352 g (1 mole) of Diacid 1550. Catalyst (1.0 g of potassium hydroxide) was charged to the reactor. The temperature was raised to 110° C. and the reactor was vacuum stripped for 30–60 minutes to remove any residue water from previous washing of the reactor or from one or more of the charged reactants or catalyst. The reactor was purged with nitrogen to remove air, evacuated again and purged again with nitrogen. The contents of the reactor were stirred and heated to 140° C. and 100 g (2.3 moles) of ethylene oxide was added to the reactor. The pressure inside the reactor immediately built up to 30–50 psig. After 30–60 minutes' induction time, an exothermic polymerization reaction (to 150°–160° C.) began. The reaction was accompanied by a pressure drop to zero (0 psig) as the ethylene oxide was consumed. Ethylene oxide was added to the reactor to a total of 660 g (15 moles). The temperature was maintained at 150°–160 ° C. by cooling. Addition of ethylene oxide was stopped and the reaction was allowed to continue for 30 minutes more. The reactor was cooled to 90°–100° C. and purged twice with nitrogen.

A sample of the product had a hydroxyl value of 110 mg of KOH/g (15 moles of ethylene oxide added to the diacid.) The diester was acidified with acetic acid to neutralize the potassium hydroxide catalyst and treated with 3 g of hydrogen peroxide to bleach and lighten the color of the product. The reactor was cooled to 30° C. prior to removing the product, which was filtered through filter paper, using a porcelain filter.

B. Reduction to the Polyoxyethylene Diester

The product of Example 4A and 25 g of nickel on kieselguhr were charged to a stirred, heated pressure vessel. The mixture was heated to 160°–170° C. and pressurized with hydrogen to 400 psig. After 6–8 hours, samples were removed at intervals for determination of the iodine value. The reaction was continued until the iodine value was less than 0.5 g/100 g of sample.

EXAMPLE 5

Preparation of Phosphated Polyoxyethylene Diester (R is $(HO)_2P(=O)(OCH_2CH_2)_nOCH_2CH_2$—)

Polyoxyethylated (15 moles of ethylene oxide) diester, obtained as in Example 4B was heated to 50°–60° C., stirred and purged thoroughly with nitrogen to remove air. To about 1015 g (1 mole) of this material was added 24 g (0.17 mole) of phosphorus pentoxide. An exothermic reaction began immediately, with an exotherm to 85°–95° C. The reaction mixture was maintained at this temperature by cooling and an additional 24 g (0.17 mole) of phosphorus pentoxide was added. The reaction was continued for three hours after all of the phosphorus pentoxide was added. The reactor was colored to 50° C. prior to removal of a sample. The acid value of the product was 32 mg KOH/g, indicating that the reaction was complete. The batch was bleached at 85°–95° C. with 5 g of hydrogen peroxide, cooled to 30° C. and filtered.

EXAMPLE 6

Aroylpolyoxyethylene Cycloaliphatic Diester

An aroylpolyoxyethylene cycloaliphatic diester was synthesized in a two-liter autoclave fitted with nitrogen purge, condenser and receiver for the removal of by-product water. Charge weights were:

510.0 g.: Diacid 1550

2.0 g.: flake caustic 636.0 g.: ethylene oxide

After purging the system with nitrogen, Diacid 1550 and caustic were heated to 130° C. Ethylene oxide was added over a four-hour period, during which the temperature was kept at 150°–165° C. The resulting ethoxylated product was cooled to 90° C. for removal of a sample. The (by hydroxyl value) was 139. To this intermediate was added:

3.5 g.: acetic acid (glacial)

7.5 g.: methanesulfonic acid (70%)

340.0 g.: benzoic acid

After purging with nitrogen, the temperature of the mixture was raised to and held at 165°–170° C. until the acid value was less than 5 mg KOH per gram. The theoretical amount of water was removed during the reaction and collected in the receiver. The sample was cooled and filtered.

The filtered product was hydrogenated in a two-liter autoclave:

1000.0 g: ethoxylated product, above 50.0 g: Raney nickel

QS: hydrogen

The reduction was run at 100°–125° C. and 200–250 psig until hydrogen consumption ceased. The product was cooled and filtered.

EXAMPLE 7

A waterless dyeing composition was prepared from 20 parts by weight of sunflower oil and 80 parts by weight of a mixture of bis(2-ethylhexyl)cycloaliphatic diester of Example 3 and tris(2-ethylhexyl)trimellitate (Eastman) in 20:80 weight ratio. The dye bath also contained 5 grams/liter of Disperse Blue 60 and 0.1% by weight of triphenyl phosphite.

This composition was kept at 185° C. and stirred while a piece of polyester fabric was immersed therein for 30 sec. The specimen was removed from the bath, washed in perchloroethylene and dried. The fabric was homogeneously colored with good dye fixation, although the color was slightly less deep than in Example 1. There was little or no smoking during the coloring operation.

EXAMPLE 8

Dip dye solution was made from 80 parts by weight of tris(2-ethylhexyl)trimellitate, 20 parts by weight of bis(2-ethylhexyl)cycloaliphatic diester and 0.1% by weight of triphenyl phosphite.

To this was added Sandoz Pigment Yellow 2B at a level of 5 g/l. The resulting composition was used to dye a piece of nylon carpet (200° C., 2 min). The experiment was otherwise as in Example 7. The nylon carpet was dyed yellow with good levelness.

EXAMPLE 9

The vehicle of Example 8, without dye, was heated at 185° C. for 4 hours. No smoking was observed. At the end of the test, the bath was slightly yellow in color.

EXAMPLE 10

Sunflower oil was heated at 185° C. for four hours. At the end of this time, the oil was slightly yellow in color.

The temperature was gradually raised. At 280° C. the bath began to smoke. Therefore, the oil-based dye baths of this invention can be used at high temperatures without contributing to atmospheric pollution in the dye plant.

EXAMPLE 11

(a) Dye solution comprising ethylene glycol, containing 1 gram/liter of pure presscake blue dye, was heated to 180° C. with constant stirring. The solution began to smoke at about 107° C. Smoking became very troublesome at 125° C. and even worse at 180° C.

Into the solution at 180° C. was immersed a six-inch piece of polyester zipper. After one minutes' immersion, the zipper was removed, cooled in air and cleaned in perchloroethylene solution, to remove residual dye solution. The zipper was difficult to clean. The zipper was unevenly colored and had many splotches.

(b) A similar experiment was done, using diethylene glycol as solvent. The dyed product was unevenly dyed and had many splotches.

These experiments demonstrate that use of glycol solvents is unacceptable from a pollution standpoint and that unacceptable dyeings are obtained.

EXAMPLE 12

Dip dye solution is made from the following ingredients, as above:

parts by weight

40—hydrogenated cycloaliphatic diester with 2-ethylhexyl alcohol (Example 3)
60—soybean oil
1—Latyl Blue BCN 356

The dip dye solution is used as above with similar results.

EXAMPLE 13

A dye bath composition is made by combining materials prepared as above in the following amounts by weight:

parts by weight

20—bis(2-ethylhexyl)ester
40—trioctyl trimellitate
40—hydrogenated soybean oil
1.5—Disperse Blue 56

The composition is used for the dyeing of a polyamide carpet sample. Results are as above.

EXAMPLE 14

A 3/16 inch stainless steel tank of 70 gallon capacity, containing 520 pounds of dip dye solution of sunflower and soybean oils (50:50 ratio), at a dye level of 0.75 pound of Latyl Blue BCN 356 (crude ground dye) is heated externally to provide a bath temperature of 185° C.

A pump is used to circulate material in the dye bath during heating and while a polyester zipper about two feet long is immersed in the stirred bath for about 45 seconds. The zipper is removed from the bath and squeezed lightly with a roller to remove excess dye solution. The zipper is washed in a tank containing a mixture of trichloroethylene and perchloroethylene. After 45 seconds' immersion in the wash liquid, the zipper is dried in a hot air chamber. The zipper is ready for final inspection and shipment.

The zipper is rapidly dyed by this procedure and is pleasant in appearance.

EXAMPLE 15

Dip dye composition is made from:

parts by weight

90—sunflower oil
10—mineral oil (Bayol 72)
2—Disperse Blue 56

The composition is used as in the preceding examples for dyeing of an acrylic carpet swatch. Similar results are obtained.

EXAMPLE 16

A composition was made from:

parts by weight

5—sunflower oil
7—POE(25)hydrogenated castor oil
5—POE(10)nonylphenol phosphate
3—1025 polypropylene glycol ditallate
80—water The resulting emulsion is used as a spin finish composition.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

I claim:

1. A waterless dip dye composition for apparel or other articles, made from thermoplastic, comprising a triglyceride fat or oil of the formula $$\begin{array}{l} CH_2O\text{—acyl} \\ | \\ CHO\text{—acyl}' \\ | \\ CH_2O\text{—acyl}'' \end{array}$$

wherein acyl, acyl' and acyl'' each are saturated or unsaturated substituted or unsubstituted linear alkanoyl of an even number of carbon atoms from 10–30 carbon atoms and an organic colorant.

2. The composition of claim 1, wherein at least 50% by weight of acyl, acyl′ and acyl″ is oleoyl or linoleyl.

3. The composition of claim 1, wherein at least 50% by weight of acyl, acyl′ and acyl″ is oleoyl, linoleoyl or stearoyl.

4. The composition of claim 1, wherein the triglyceride fat or oil is sunflower oil.

5. The composition of claim 1, wherein the triglyceride fat or oil is 10–90 parts by weight of sunflower oil and 90–10 parts by weight of soybean oil or partially hydrogenated soybean oil.

6. The composition of claim 1, wherein the organic colorant is a disperse dye.

7. The composition of claim 1, further containing at least 5% by weight of a high boiling petroleum oil.

8. The composition of claim 1, containing at least 5% by weight of one or more of:

A. an aromatic polyester of the formula $C_6H_{z'}(COOR_1)_z$, wherein $R_1$ is substituted or unsubstituted alkyl of 6–22 carbon atoms or the residue of an alkylphenol ether of an alkoxyalkanol; z is 3, 4, 5, or 6 and z′ is 6-z;

B. a cycloaliphatic diester of the formula

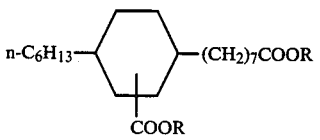

wherein R is substituted or unsubstituted straight or branched chain alkyl of 4–20 carbon atoms, polyoxyalkylene of the formula $R'(OC_xH_{2x})_n$ or phosphated polyoxyalkylene of the formula $(HO)_2P(=O)(OC_xH_{2x})_nOC_xH_{2x}-$ or a salt thereof, wherein $(C_xH_{2x}O)_n$ is $(C_2H_4O)_n-$, $(C_3H_6O)_n-$ or $(C_2H_4O)_p-(C_3H_6O)_q-$; R′ is H or ArCO; Ar is substituted or unsubstituted mono- or bicyclic aryl of up to 15 carbon atoms; x is 2 or 3; n is 2–22 and the sum of p+q is n; or C. a bisterephthalate ester of an alkylphenylpolyoxyethanol of the formula

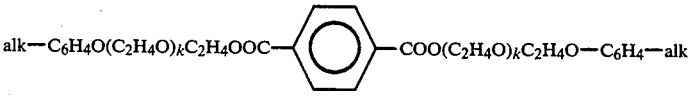

wherein alk is straight or branched chain alkyl of 4–15 carbon atoms and k is 3–20.

9. The composition of claim 8, containing at least 5% by weight of the aromatic polyester.

10. The composition of claim 8, containing at least 5% by weight of a cycloaliphatic diester, wherein alkyl is of 6–20 carbon atoms.

11. The composition of claim 8, containing at least 5% by weight of trialkyl trimellitate, wherein alkyl is of 6–22 carbon atoms and at least 5% by weight of cycloaliphatic diester, wherein R is alkyl of 6–20 carbon atoms.

12. The composition of claim 8, containing 5–90% by weight of triglyceride fat or oil.

13. The composition of claim 8, containing 5–85% by weight of triglyceride fat or oil, 15–95% by weight of aromatic polyester and 0–15% by weight of cycloaliphatic diester.

14. The composition of claim 13, wherein the aromatic polyester is tris(2-ethylhexyl)trimellitate and the cycloaliphatic diester is the bis(2-ethylhexyl)diester.

15. The composition of claim 2, consisting essentially of 5–90% by weight of sunflower oil and 95–10% by weight of a mixture of trialkyl trimellitate, wherein alkyl is of 6–22 carbon atoms, and cycloaliphatic diester, wherein R is alkyl of 6–20 carbon atoms; and organic colorant.

16. The composition of claim 15, wherein the trialkyl trimellitate is tris(2-ethylhexyl)trimellitate and the cycloaliphatic diester is the bis(2-ethylhexyl)diester in 60:40 to 90:10 weight ratio.

17. A process for coloring articles, made from thermoplastic materials comprising exposing an article being treated to a composition of claim 1, maintained at a temperature from 100° C. to the temperature at which the plastic degrades, for a time adequate to achieve the desired degree of coloration.

18. The process of claim 17, wherein the plastic is polyester, polyamide, polyurethane, acrylic or halogenated polyolefin or epoxy.

19. The process of claim 17, wherein the article is immersed in the coloring composition at a temperature of at least 140° C. for at least 1 minute.

20. The process of claim 17, wherein the article is sprayed with the coloring composition and heated in a bath or oven to at least 140° C.

21. The process of claim 17, including the further steps of cleaning the colored article with a halogenated solvent and drying the thus-cleaned article.

22. The process of claim 17, wherein the halogenated solvent is perchloroethylene or trichloroethylene and the halogenated solvent is collected and recycled to the process.

23. A process for coloring articles, made from polyester, polyamide, polyurethane, acrylic, halogenated polyolefin or epoxy plastic, comprising exposing an article being treated to a waterless coloring composition of claim 15, maintained at 120°–235° C., for a time adequate to achieve the desired degree of coloration.

24. The process of claim 23, wherein the article is immersed in the coloring composition at a temperature of at least 140° C. for at least 1 minute.

25. The process of claim 24, including the further steps of drying the colored article, cleaning the article with a halogenated solvent and drying the thus-cleaned article.

* * * * *